US005323544A

United States Patent [19]

Osgood

[11] Patent Number: 5,323,544

[45] Date of Patent: Jun. 28, 1994

[54] METHOD AND APPARATUS FOR DRYING COATINGS OR FILMS

[75] Inventor: John H. Osgood, Dothan, Ala.

[73] Assignee: Ansell Incorporated, Eatontown, N.J.

[21] Appl. No.: 7,539

[22] Filed: Jan. 22, 1993

[51] Int. Cl.[5] ..... F26B 3/34

[52] U.S. Cl. ..... 34/247; 34/104; 34/256; 425/174.8 R; 425/270; 425/275; 427/544

[58] Field of Search ..... 34/1 K, 1 L, 1 N, 21, 34/104, 105, 106, 1 B; 118/620, 58, 59; 219/10.75, 10.79; 427/543, 544, 547, 133, 135; 425/270, 272, 275, 174.4, 174.8 R; 264/25, 26, 301

[56] References Cited

U.S. PATENT DOCUMENTS

| | | | |
|---|---|---|---|
| 2,263,681 | 11/1941 | Hart, Jr. | 34/1 |
| 2,353,256 | 7/1944 | Maywald, Jr. | 18/2 |
| 2,492,000 | 2/1949 | Morris et al. | 34/1 K |
| 2,668,226 | 2/1954 | Bernard | 34/1 N |
| 4,806,388 | 2/1989 | Mochizuki et al. | 427/544 |
| 5,248,528 | 9/1993 | Robbins et al. | 427/544 |

*Primary Examiner*—Denise Gromada
*Attorney, Agent, or Firm*—Gardner, Carton & Douglas

[57] ABSTRACT

A technique is disclosed for drying and curing a liquid film applied to a former which is reactive to radio frequency energy so as to generate heat. A liquid film, such as latex, is applied to a metallic former which is then disposed in the proximity of an applicator which propagates radio frequency energy. In response, by a process of induction the former generates heat and thereby advantageously dries said film in an inside-to-outside manner. A superior product is produced which is substantially free of defects and blemishes.

20 Claims, 3 Drawing Sheets

Fig. 1
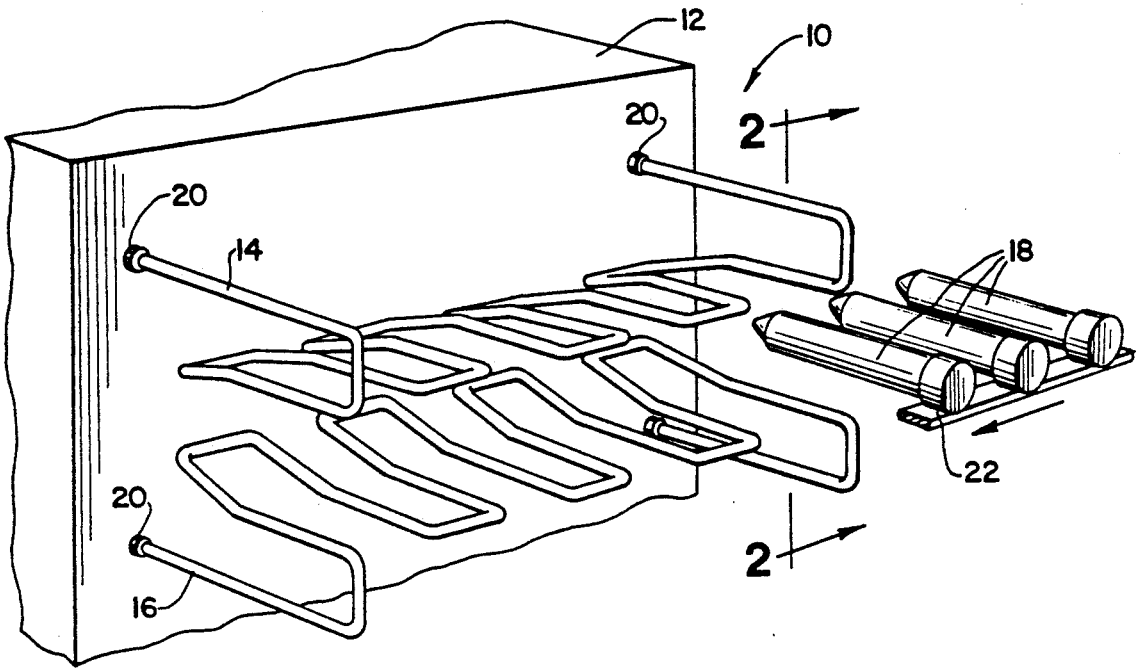
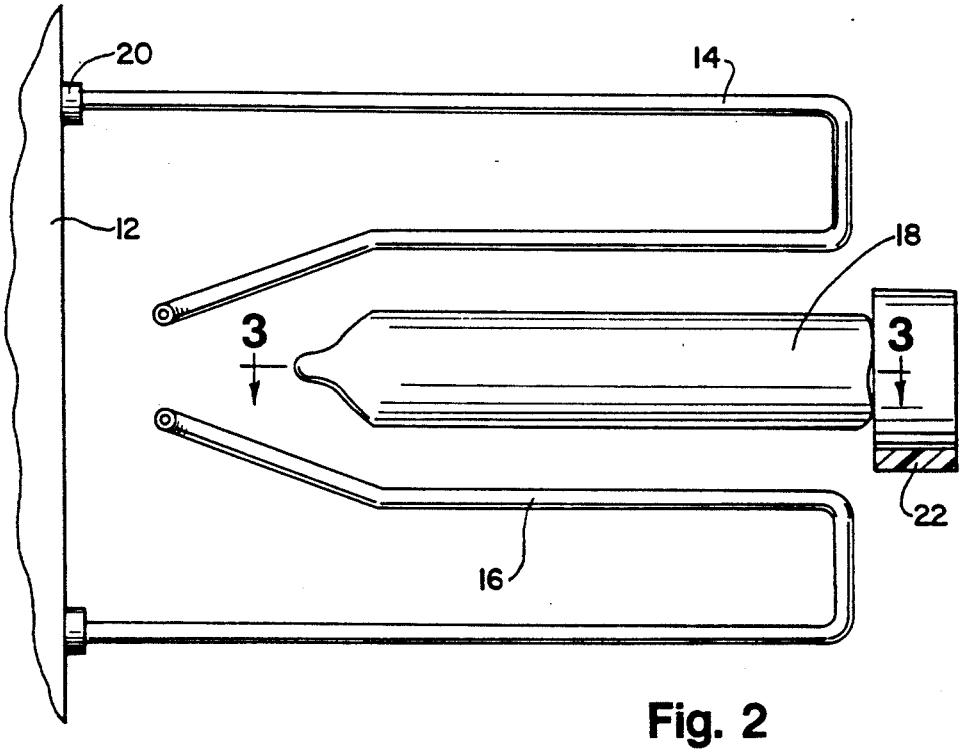
Fig. 2

Fig. 5
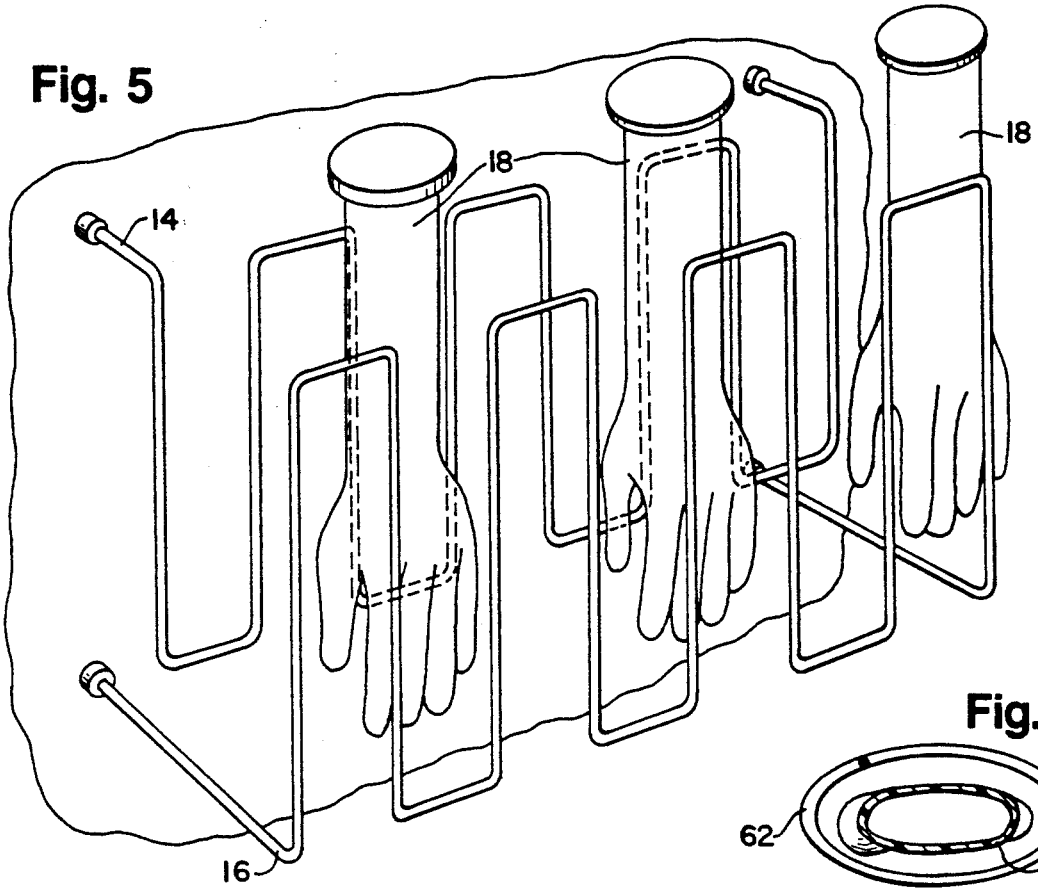
Fig. 7
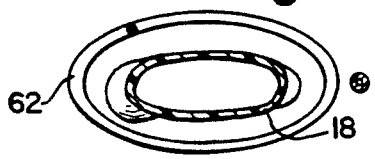
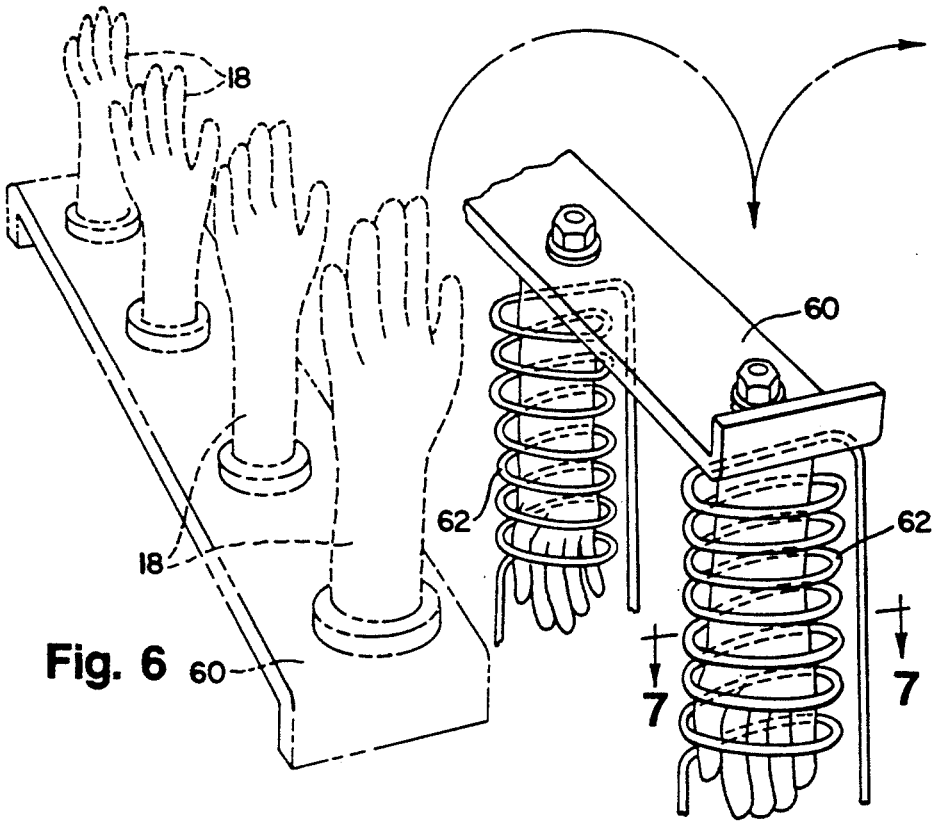
Fig. 6

METHOD AND APPARATUS FOR DRYING COATINGS OR FILMS

FIELD OF THE INVENTION

The present invention relates generally to techniques for drying films or coatings, and more particularly to a technique for the efficient production of substantially blemish-free latex-dipped products, such as gloves and condoms.

BACKGROUND OF THE INVENTION

Conventional techniques for producing natural latex and synthetic latex condoms and gloves involve, generally, the steps of dipping a former into a vat or tub of liquid latex to apply a relatively thin film to the former, placing the former with the applied coating into a conventional oven to dry and cure the product, removing tile cured product from the former and repeating the process. A wide variety of additional steps may typically be included in the process to produce specific features or a higher quality product, such as, for example, multiple dipping applications to produce a laminated or thicker film or forming rings at the edges of the product. Mass production of latex products is typically accomplished in a batch process or by using a continuous chain or belt that carries a plurality of formers. The chain is continuously driven at a steady rate through each station where a step of the process is performed. The batch process uses a plurality of formers rigidly mounted on a plate, the plate being advanced in discrete steps. Desired qualities of such latex products include uniformity of thickness, purity of composition, tensile strength and resistance to deterioration.

Although defects or impurities may be introduced at any step of the process, many product defects are caused during the drying and curing steps. Contamination, "mud-cracking" and "skinning oven" are examples of product defects that may be introduced during the conventional drying and curing stages of the production process. Mud-cracking, or gel-cracking is a product defect caused during prior art drying processes due to the fact that the outer surface dries first, or skins over. As drying progresses inwardly, the material beneath the surface dries and shrinks. The surface skin, which is developing, attaches to the gelling and shrinking material beneath the skin and is ruptured into fissures as the material beneath the surface skin shrinks. In accordance with the present invention, this prior art defect is overcome if the drying first takes place at the inner surface next to the former because this gelled material cannot shrink since its size is maintained by the former. As drying progresses outwardly, shrinking of gelled material is prevented by the rigid former and the solid material beneath the ungelled portion.

Skinning over is another product defect caused during prior art processes where the outer layers of the film commence drying and form a solid surface that acts as a barrier which prevents moisture and other volatiles trapped within the inner layer from escaping as the inner portion of the film drys. The unwanted trapped substances result in the production of discontinuities that weaken and compromise the integrity of the final product.

Conventional ovens, usually in the form of long ducts which form tunnels, typically use steam heated radiators which heat the air forced through tile ducts. Alternatively, hot gases of combustion from gas burners, mixed with incoming air, may be forced through the ducts. Sometimes radiant heat is used to dry and cure the product on the formers. Since drying of the product during such conventional prior art heating processes initiates with the outer surface of the film, those processes prevent evaporation of volatiles which are trapped beneath the outer skin of the film. In addition, hot air forced through the ducts carries dirt and dust which impinges on and blemishes the product.

Of an entire production cycle, a relatively short amount of time is spent in the steps of applying the liquid latex. The majority of the cycle time involves drying and curing in the ovens, thereby increasing the likelihood that product defects will be introduced during the drying stage. For example, a typical mass production apparatus for producing condoms may be comprised of a first dipping step, a second dipping step, ring formation, drying and curing. The entire production cycle may take twenty-five minutes, and due to the general inefficiency of the ovens, the curing and drying steps may comprise twenty minutes or 80% of the entire cycle time.

A great deal of the heat from the ovens is, during a mass production process, released into the atmosphere of the factory, creating an extremely uncomfortable environment for the factory personnel. In addition, the gases and fumes created during the drying process often interfere with the performance and comfort of the factory personnel.

U.S. Pat. Nos. 5,049,323 to Giles, Jr., 5,082,436 to Choi et al., and 5,101,085 to Minnich are generally directed to heating techniques which use radio frequency energy to thermostamp and cure thermoplastic composites. Radio frequency sensitizing agents are added to the uncured composite which is then heated by subjecting it to radio frequency energy. U.S. Pat. No. 5,116,551 to Davidson et al. involves drying of a liquid-containing coating by application of microwave radiation. Each of these prior art techniques, however, are directed to application of an energy source that directly and primarily affects the material of the product being produced. As a result, if such techniques were used to dry, for example, latex dipped products, the outer layer of the film would tend to dry first, trapping unwanted volatiles and residue beneath the dried outer skin of the film, resulting in several undesirable product defects.

SUMMARY OF THE INVENTION

It is a primary object of the present invention to provide a technique for drying and curing a liquid latex or other liquid film on a former which ensures that the innermost layer of the film drys first, thereby allowing volatiles ordinarily trapped within to escape through the outer undried portion of the film.

It is another object of the present invention to provide a technique for drying and curing a liquid latex or other liquid film which rapidly drys or cures the film.

It is another object of the present invention to provide a technique for drying and curing a liquid latex or other liquid film that results in relatively insignificant quantity of heat escaping into the proximate environment.

It is another object of the present invention to provide such a technique that may be readily adapted to replace the drying and curing stations of a conventional mass production apparatus.

The above and other objects and advantages are realized in accordance with the present invention which provides an efficient technique for drying and curing latex or other liquid films or coatings to produce high quality products and a reduction in product defects. The present invention represents a fundamental advance over the prior art techniques in that it recognizes that, in order to promote substantially inside-to-outside drying of a film applied to a former, the drying energy applied must be effective to heat the former yet substantially "transparent" or directly ineffective with respect to the film or coating itself.

According to a preferred embodiment of the present invention, inside-to-outside drying of a film applied to a former is accomplished by radio frequency induction heating. The former, when subjected to radio frequency energy generates heat which operates to dry the film commencing from the innermost portion of the film adjacent the former and progressing toward the outer surface of the film. The technique of the present invention, therefore, ensures inside-to-outside drying and results in the efficient production of a uniform high-quality product.

BRIEF DESCRIPTION OF THE DRAWINGS

Other objects and advantages of the invention will be apparent from the following detailed description and upon reference to the drawings, in which:

FIG. 1 is a perspective view of an apparatus used to dry or cure condoms in accordance with a preferred embodiment of the present invention;

FIG. 2 is a cross-sectional view taken at 2—2 of FIG. 1;

FIG. 5 is a perspective view of an apparatus for drying and curing gloves in accordance with a preferred embodiment of the present invention;

FIG. 6 is a perspective view of a batch process for drying or curing articles in accordance with the present invention in which a plurality of formers are moved and oriented in discrete steps; and FIG. 7 is a cross-sectional view taken at 7—7 of FIG. 6.

DETAILED DESCRIPTION OF THE INVENTION

Figure 3:
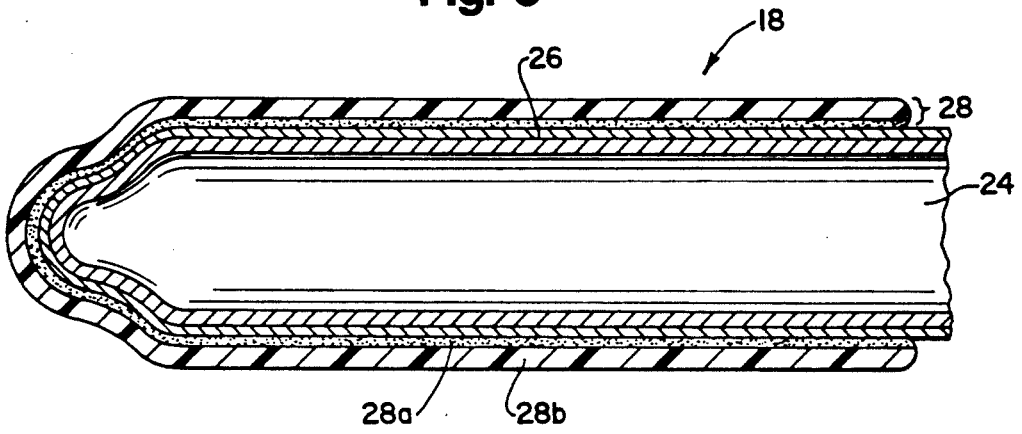
FIG. 3 is a cross-sectional view taken at 3—3 of FIG. 2 depicting the composition of a condom former and an applied liquid film in accordance with a preferred embodiment of the present invention.

Turning to FIG. 1, there is shown an apparatus 10 for drying and curing liquid films applied to a former in accordance with a preferred embodiment of the present invention. A radio frequency generator 12 is provided with a pair of applicator arms 14, 16 which serve to propagate radio frequency energy which heats the formers 18 by induction. The applicator arms 14, 16, are comprised of a length of metallic tubing such as copper, which is an effective conductor of radio frequency current.

According to a preferred embodiment of the invention, the metallic tubing is encased or wrapped in an electrically insulating material, such as plastic. Although the insulating material does not itself enhance the performance of the apparatus, it protects workers or operators from the severe electrical shock that would result if the tubing were touched while energized. Similarly, the insulators protect against electrical shocks or damage that might be caused if the conveyor mechanism or other elements of the system inadvertently came into contact with the tubing while it was energized.

The upper 14 and lower 16 applicators are preferably arranged in a serpentine configuration along the length of the generator 12, and are spaced apart to form a channel that, as seen in FIG. 2, closely conforms to the periphery of the former 18 coated with a liquid film, such as liquid latex. The width of the channel is, at all points, greater than the width of the former 18 coated with film, so as to ensure that the applicator 14, 16, including the insulating material, does not come into contact with the former 18 or the applied film.

It is preferred that the applicators 14, 16 are arranged so as to define a channel which relatively closely accommodates the contour of the former 18, since the effectiveness of radio frequency energy transmitted by the applicators 14, 16 is a function of the distance between the former 18 and the applicators 14, 16. Thus, in general, the radio frequency energy transmitted by the applicators 14, 16 will be more effectively and efficiently utilized as the applicators 14, 16 are located more closely to the former 18. For this reason, the applicators 14, 16 as illustrated in FIGS. 1 and 2 are bent slightly toward each other near the chassis in order to more closely follow the contour of the tip of the elongated formers 18.

The applicator tubing 14, 16 may be secured at both ends by a pair of collars 20 or sleeves which are threadedly or boltedly engaged to the chassis of the generator 12. The tubing 14, 16 may be cooled, particularly during prolonged use, by liquid circulation in a conventional manner. Such a cooling liquid could be circulated through a separate, preferably electrically insulated, tubing wrapped in a spiral manner about the length of the applicator tubing 14, 16. Alternatively, the cooling liquid could be circulated within the applicator tubing 14, 16 itself, entering at one end and exiting at the opposite end of the applicator tubing 14, 16. The liquid may be cooled so as to maintain the temperature of the tubing 14, 16 within a predetermined acceptable range by a number of conventional techniques.

As part of the process of mass production of latex articles, a train of formers 18 with a recently applied liquid film are paraded along the production line. The formers are typically attached in a conventional manner to an endless conveyor apparatus 22 disposed so as to pass the formers through the channel. The conveyor apparatus 22 may include a belt or track that allows rotation of the formers 18 about their longitudinal axis as they proceed through the channel.

Turning now to FIG. 3, there is shown, by way of example, a cross-sectional view of a former 18 according to a preferred embodiment of the invention. The former 18 illustrated in FIG. 3 is shaped so as to provide a mold for a condom. According to an important aspect of the present invention, the core 24 of the former is composed of a substantially magnetic material, such as steel or iron, which will readily heat in response to the application of radio frequency energy. Although a wide variety of materials, including various alloys, may be used as the core 24 of the former 18, it is important that the material selected, in order to be effective in accordance with the present invention, readily generate heat when subjected to radio frequency energy. Thus, the former 18 receives radio frequency energy and transforms it into heat which drys the applied film.

Since the former is dipped or otherwise comes into direct contact with a liquid film, such as liquid latex and water spray, a non-oxidizing platting 26 such as chromium or nickel is applied to the core 24 of the former 18 to prevent rust. A suitable plating 26 for the production of condoms is a plating 26 of chromium upon the core 24. Although the plating 26 itself is not particularly radio frequency reactive, i.e., effective at generating heat in response to radio frequency energy, the plating 26 conducts heat generated by the core 24 and is thin so that it does not substantially hinder heat from the core of the former being transmitted to the film 28 on its surface. A suitable thickness of plating 26 would be in the range of about 0.001 to about 0.01 inches, and would preferably be about 0.003 inches.

The former 18 illustrated in FIG. 3 has been coated with a liquid film 28, such as liquid latex. The film 28 is typically applied to the former 18 by a conventional dipping process, but may be applied by any other technique that coats the surface of the former 18 with a liquid film 28. According to an important aspect of the invention, when the former 18, with an applied coating of a liquid film 28, is subjected to radio frequency energy, the film 28 is unaffected directly by the magnetic field. The former 18, however, and particularly the magnetic core 24, being reactive to the radio frequency energy, generates heat which is transmitted to the film 28 applied to the former 18. The heat generated by the former 18 is transmitted initially to the portion of the film 28*a* adjacent to the surface of the former, i.e., the "inside" of the film 28*a*, and then to the middle and eventually to the outer layer of the film 28*b*. Thus, by the present invention, the film 28 applied to the former 18 is dried in a substantially inside-to-outside manner, thereby allowing liquid molecules, gases and other undesirable by-products to escape through the outer 28*b* undried layers of the film. This inside-to-outside drying process represents a substantial advance over prior art techniques in that it overcomes the inherent deficiencies and likelihood of defects resulting from the conventional outside-to-inside drying process.

Turning back to FIGS. 1 and 2, the formers 18, which have been coated with a liquid film 28, progress along the production line and approach the channel of the applicators 14,16. As the formers 18 near the vicinity of the channel, radio frequency energy produced by the generator 12 and propagated by the applicators 14, 16 is "received" by the core 24 of the former. In response, the core 24 begins to heat and continues to heat as the former 18 passes into the channel defined by the applicator arms 14, 16. Due to the heat generated by the core 24 of the former 18, the film 28 begins to dry, starting from the inner layers 28*a* in direct contact with the former 18 and progressing toward the outer layers 28*b*. During the drying process, volatiles and other liquids within the inner layers 28*a* of the film evaporate through the undried outer layers 28*b*. As a former 18 leaves the channel, and during its passage enroute to another station in the production line, the film including the outer layers 28*b* upon the former 18 is substantially dried from the heat generated by the core 24 of the former 18 in response to the radio frequency energy.

As should be evident, the generator will preferably include a set of controls, such as knobs and switches, as well as digital or deflection meters in order to monitor and control performance of the apparatus. For example, a knob may be provided to adjust the power or current through the applicator arms, while a meter may be provided to display the present power or current characteristics. Another knob and meter may be provided to adjust and monitor the frequency of the radio frequency energy produced by the generator. The invention may be practiced within a rather wide radio frequency range, from possibly as low as 25 Hz to as high as 50 Mhz, as long as the energy produced by the generator operates to heat the former. The invention may be practiced, for example, at a radio frequency of about 1 Mhz. In addition to an on-off switch, another switch may be provided to put the generator in a dwell mode, whereby radio frequency energy to the applicators is temporarily disrupted. Such a feature would allow an operator, for example, to adjust the applicator arms without risk of electrical shock or damaging the generator equipment.

In practice it is found that when a latex film with a thickness of between about 0.001 to about 0.04 inches, i.e. the typical range of thickness to produce condoms or gloves is applied to a magnetic former, the film may be dried with superior results after application of radio frequency energy of only a few seconds. Similarly, curing of such a dried film may be performed in accordance with the present invention usually by subjecting the former to radio frequency energy for merely a few seconds. It should be noted that since the metallic former remains hot for some time after application of the radio frequency energy, drying and curing of the film upon the former continues after the former leaves the drying or curing station. Thus, the heat within the former operates to continue drying and curing the product.

According to an important aspect of the invention, substantially all of the heat generated by the core 24 is utilized by the formers 18 to dry the film 28. In contrast to typical prior art techniques which result in the escape of substantial quantities of heat, the technique of the present invention does not appreciably increase the ambient temperature in the proximity of the generator. As a result, workers in the factory operating the production line can work in relative comfort at temperatures well within an acceptable range. Thus, the present invention provides not only a superior product, but does so in an energy efficient manner that allows relatively steady maintenance of ambient conditions, and makes feasible close control of ambient temperature and humidity (air conditioning) further enhancing the ability to produce a superior product.

Figure 4:
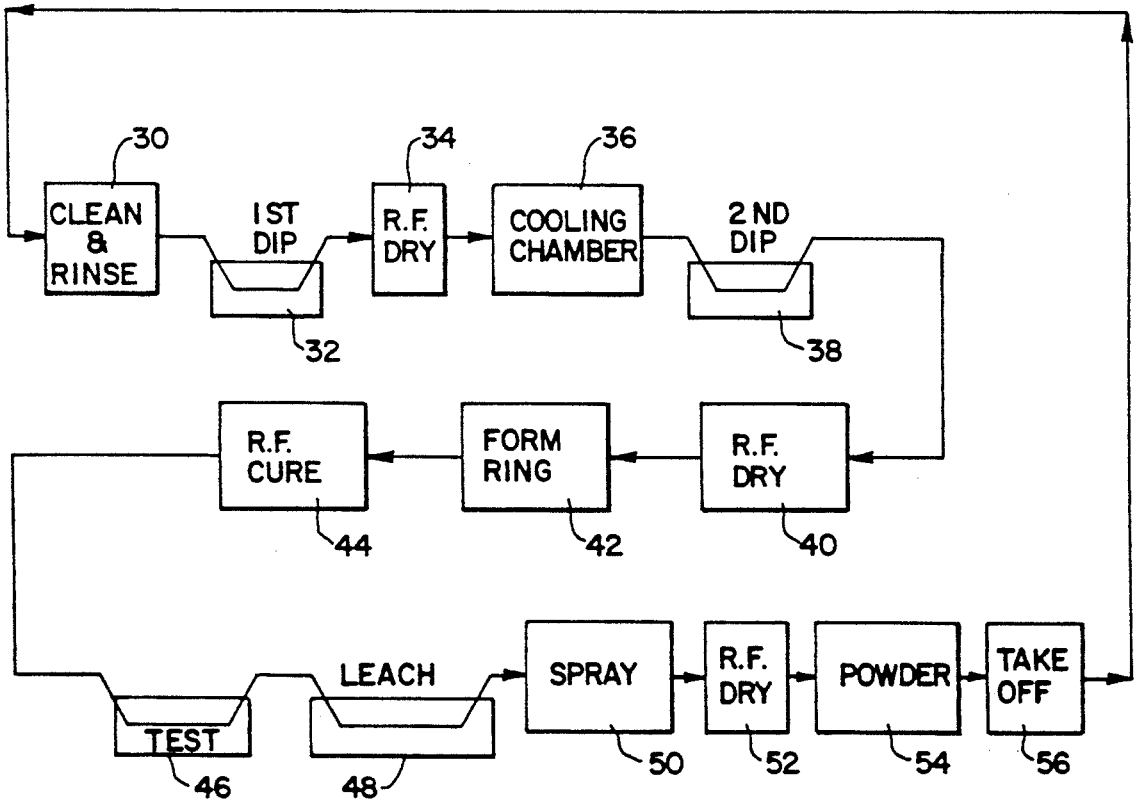
FIG. 4 is a schematic flow diagram depicting a mass production process cycle utilizing the drying and curing techniques of the present invention.

Turning now to FIG. 4, there is shown a flow diagram depicting, by way of example, the production cycle for a latex article utilizing the present invention to dry and cure the latex article at the appropriate stations. It should be understood that the illustrated production cycle is shown by way of example, and several additional production techniques and steps may be included and others removed, while the cycle still utilizes the superior drying and curing technique of the invention. As can be seen, the production cycle is continuous, typically using many—oftentimes thousands—formers which serve as a mold for the products produced.

At the first station 30 of the production cycle, the formers, typically carried upon a continuous belt or similar conveyor apparatus, are cleaned and rinsed, removing debris or by-products from the surface of the formers. At the next station 32 a liquid film is applied to the formers by dipping them into a bath or vat of liquid, such as latex. The formers may be rotated to ensure that a smooth and uniform coating is applied to the surface of the former.

At the next station 34, the formers are subjected to radio frequency energy, such as by an apparatus illustrated in FIG. 1. The formers, being composed of radio frequency reactive material generate heat in response to the radio frequency energy. The heat generated by the former is transmitted to and drys the liquid film, commencing with the inner layers and progressing toward the outer layers, thereby advantageously facilitating evaporation during the drying process.

Due to the overall efficiency of the radio frequency technique of the present invention, the heating process may be completed in merely a few seconds and the former will shortly pass to the next station of the process cycle. In a typical mass production process cycle, formers are moved along on a conveyor apparatus traveling about 50 to 100 feet per minute. At such a conveyor speed, the applicators, in order to subject the formers to radio frequency energy for several seconds, would be approximately 3 to 10 feet in length—a substantially shorter distance than with a conventional oven, which would typically require the former to traverse a distance of more than one hundred feet before the film is dry. Thus, according to another advantageous aspect of the present invention, the drying time is substantially reduced thereby also substantially reducing the likelihood that product defects will be introduced at the drying station.

At the next step 36 of the production cycle, the former, with a freshly applied and dried film, may be cooled in preparation for application of a second coating of film. The former is then again dipped into a bath of liquid at the next station 38 in order to apply a second layer of film.

The former, with a second layer of freshly coated film, proceeds to the next station 40 where the former passes through another channel defined by applicator arms which propagate radio frequency radiation which is "received" by the core of the former. Again, in response to the radio frequency energy, the former generates heat which drys the freshly applied coating of film by the advantageous inside-to-outside drying technique of the present invention.

After being subjected to radio frequency energy for several seconds, the former, with a second layer of film emerges from the channel and passes to the next station 42, drying further from the heat of the former while enroute. A ring is formed at the base of the product—a standard practice when producing latex condoms or gloves—by using a conventional technique 42.

The former, now with a dried layer of latex, is subjected again to radio frequency energy at the next station 44. As before, the radio frequency energy heats the former which results in the transmission of heat to the film. At this station 44, however, the additional application of heat from the former to the dried film serves to cure the film. As the film is cured, it is transformed into a relatively strong elastic product through molecular crosslinking and loses its tackiness, becomes relatively insoluble and more resistant to deteriorization.

At the next station 46, the dried and cured product is tested, in apparatus which may consist of conventional high-voltage testing, or a saline bath test, and then the former continues to the next station 48 where the product leached according to conventional techniques. During leaching, excess unreacted chemicals are removed.

At the next station 50 the products, still upon the formers, are sprayed, typically with water, in order to rinse the product. Excess water is removed and the product is dried at the next station 52, preferably again by application of radio frequency energy in accordance with the present invention. The former progresses to the next station 54 where the product is powdered, then removed from the former at the last station 56. The former then cycles back to the first station 30 again, in order to produce another new product.

Turning now to FIG. 5, there is shown an apparatus in accordance with an alternative embodiment of the present invention for drying and curing liquid films applied to a glove-shaped former in order to produce a glove. A pair of applicator arms 14, 16 extending from a radio frequency generator (not shown) are disposed in a generally serpentine configuration. The applicator arms are spaced apart to define a channel between which formers 18 coated with a liquid film may pass. The glove or hand-shaped formers 18 may be supported by an endless chain or belt which is driven so as to convey the plurality of formers to the various stations of the process.

If the glove-shaped formers 18 are rotated as they progress along the production line, the channel defined by the applicator arms 14, 16 should be wide enough to accommodate the greatest width of the glove-shaped former 18 after a liquid film or coating has been applied. Alternatively, if the former 18 is not rotated as it passes between the applicator arms 14, 16 the channel should be wide enough to accommodate the width of the former 18 with a coating of liquid film when the former 18 is disposed in a predetermined position with respect to the applicator arms.

According to an alternative embodiment of the invention, there is shown in FIG. 6 a process for drying or curing a liquid film applied to a former 18 which is performed in a batch process. A plurality of formers 18, which are rigidly affixed to a platform 60, are moved and oriented along the production process in a plurality of discrete steps. In the illustrated embodiment, a set of four glove-shaped formers 18 are bolted to a platform 60. As shown, after a coating of a liquid film is applied to the set of formers 18, an apparatus (not shown) which moves and positions the platform 60 along the production line moves the platform 60 to the drying or curing station. The station includes a radio frequency generator and a set of helical applicators 62 which propagate radio frequency energy produced by the generator.

The formers 18 are composed of a core of substantially magnetic material which will readily heat in response to the application of radio frequency energy transmitted by the applicators 62. Preferably, the helical applicators 62 are shaped so as to rather closely follow the contour of the former 18 when inserted within the applicator 62. As seen in FIG. 7, the applicators 62 are generally oval-shaped in order to more closely accommodate the generally oval cross-sectional shape of the former 18.

As the platform 60 of formers 18 approaches the drying or curing station, in a discrete step the platform 60, with the set of formers 18 rigidly attached, is positioned so as to maintain the set of formers 18 within the corresponding set of helical applicators 62. The formers 18 will be maintained in this position for a predetermined period during which radio frequency energy propagated by the helical applicators 62 operates to heat the formers 18 by radio frequency induction. Typically, sufficient heat will be generated by the formers 18 in response to only a few seconds of radio frequency energy to dry or cure the applied liquid coating. After the predetermined period, in another discrete step, the platform 60 is moved so as to remove the set of formers 18 from the corresponding set of helical applicators 62 and on to the next station of the production process.

As can be seen from the foregoing detailed description, the present invention provides a unique, efficient and superior technique for drying and curing a liquid film applied to a former. The process is performed by subjecting a former with a magnetic core to radio frequency energy. In response, the former heats and drys the applied coating from inside-to-outside and if the former is subjected to additional radio frequency energy the dried coating will cure on the former.

What is claimed is:

1. An apparatus for drying a liquid film comprising:

a former which is comprised of a substantially magnetic material and is substantially reactive to radio frequency energy so as to generate heat;

means for applying said liquid film to said former;

a radio frequency energy source and means for propagating radio frequency energy generated by said radio frequency energy source;

means for disposing said former with said liquid film within an effective proximity to said propagating means so as to result in the generation of heat by said former, which heat is transmitted to and drys said liquid film; and means for removing said dried liquid film from said former.

2. The apparatus as set forth in claim 1 wherein said former is comprised of a core of substantially magnetic material and an outer plating which is non-oxidizing.

3. The apparatus as set forth in claim 2 wherein said outer plating is comprised substantially of chromium and is between about 0.001 and about 0.01 inches thick.

4. The apparatus as set forth in claim 2 wherein said outer plating is comprised substantially of nickel and is between about 0.001 and about 0.01 inches thick.

5. The apparatus as set forth in claim 1 wherein said radio frequency energy source generates radio frequency energy at a frequency of about 1 Mhz.

6. The apparatus as set forth in claim 1 wherein said propagating means is comprised of at least one elongated applicator.

7. The apparatus as set forth in claim 6 wherein said elongated applicator is disposed in a generally serpentine configuration.

8. The apparatus as set forth in claim 6 wherein said elongated applicator is disposed in a generally helical configuration.

9. The apparatus as set forth in claim 6 wherein said elongated applicator is disposed so as to conform to the contour of said former.

10. The apparatus as set forth in claim 1 wherein said propagating means is comprised of a pair of elongated applicator arms disposed in a generally serpentine configuration and which define a channel that conforms to the contour of said former.

11. The apparatus as set forth in claim 1 wherein said propagating means is electrically insulated.

12. The apparatus as set forth in claim 1 further comprising means for maintaining said propagating means within a predetermined temperature range.

13. A process for drying a liquid film to form a product comprising the steps of:

applying a liquid film to a former which is comprised of a substantially magnetic material, wherein said former is substantially reactive to radio frequency energy to generate heat;

subjecting said former with said liquid film to a source of radio frequency energy so that the former generates heat that drys said liquid film; and removing said dried liquid film from said former.

14. The process of claim 13 further comprising the step of subjecting said former with said dried liquid film to a source of radio frequency energy so that the former generates heat that cures said dried film.

15. The process of claim 13 wherein said former is conveyed through a channel defined by at least one applicator which propagates said radio frequency energy.

16. The process of claim 13 wherein said former is inserted into one or more generally helical-shaped applicators which propagate said radio frequency energy.

17. A process for drying a liquid film comprising the steps of:

applying a liquid film to an article which is comprised of a substantially magnetic material, wherein said article is substantially reactive to radio frequency energy to generate heat;

subjecting said article with said liquid film to a source of radio frequency energy so that the article generates heat that drys said liquid film; and removing said dried liquid film from said article.

18. The process of claim 17 further comprising the step of subjecting said article with said dried liquid film to a source of radio frequency energy so that the article generates heat that cures said dried film.

19. The process of claim 17 wherein said article is conveyed through a channel defined by at least one applicator which propagate said radio frequency energy.

20. The process of claim 17 wherein said article is inserted into at least one generally helical-shaped applicator which propagates said radio frequency energy.

* * * * *